US005121912A

United States Patent [19]

Tashiro

[11] Patent Number: 5,121,912

[45] Date of Patent: Jun. 16, 1992

[54] DOCUMENT FEEDER

[75] Inventor: Osamu Tashiro, Osaka, Japan

[73] Assignee: Sharp Kabushiki Kaisha, Osaka, Japan

[21] Appl. No.: 630,987

[22] Filed: Dec. 20, 1990

[30] Foreign Application Priority Data

Dec. 25, 1989 [JP] Japan ..... 1-336858

[51] Int. Cl.[5] ..... B65H 5/06

[52] U.S. Cl. ..... 271/3.1; 271/186; 271/902

[58] Field of Search ..... 271/3.1, 291, 186, 902

[56] References Cited

U.S. PATENT DOCUMENTS 4,099,150 7/1978 Connin .
4,744,553 5/1988 Hirose ..... 271/186 X
4,815,722 3/1989 Sugimoto ..... 271/902 X
4,970,543 11/1990 Ito et al. .

*Primary Examiner*—Richard A. Schacher

*Attorney, Agent, or Firm*—David G. Conlin; Robert F. O'Connell

[57] ABSTRACT

In the document feeder of the invention, the originals stacked in the document hopper always show the same surfaces upward during copy operation. Consequently, when an original document sheet causes paper jam or similar trouble in the transport path, the original may be restacked in the document hopper with the same surface facing upward as that facing upward when the original was first stacked in the document hopper. Consequently an operator is less likely to be confused as to the surface to face upward when stacking originals in the document hopper, resulting in improved operating performance. Further, the structure of installing the original feeding mechanism and the original restacking mechanism separately on both sides of the document hopper and bottom-feed, top-restack configuration of the document hopper simplifies the structure around the document hopper.

4 Claims, 6 Drawing Sheets

DOCUMENT FEEDER

BACKGROUND OF THE INVENTION

1. Field of the Invention

The present invention relates to a document feeder which is used while being incorporated in an electrostatographic copier, for example, to feed original document sheets successively to a reading region.

2. Description of the Prior Art

Conventional optical reading apparatuses which read information from the surface of a document optically by applying light through a slit, such as electrostatographic copiers, employ first exposure mode where a fixed document is read by a moving optical system, or second reading mode where a moving document is read by a fixed optical system. In the second exposure mode, a recirculating document feeder (called RDH hereafter) may be employed which feeds original document sheets to a reading region successively one by one and, after exposure-reading, returns the original sheets to the initial position.

FIG. 1 is a simplified sectional drawing of RDH 1 of the prior art. RDH 1 which is a typical prior art comprises a document hopper 3 where original sheets 2 to be copied are stacked, a support cylinder 5 of a straight cylinder shape which carries the original 2 to make it pass through a reading region 4, and an original transport path 8 comprising a transport path 6 to transport the original from the document hopper 3 to the reading region 4 and a transport path 7 to return the original from the reading region 4 to the document hopper 3. Originals 2 stacked in the document hopper 3 to be copied are supplied by a feed roller 9 onto the transport path 6, one sheet at a time from the top of the stack. The original 2 transported through the transport path 6 is supported by the support cylinder 5 and passes over a transparent plate 10 made of hard glass or the like which is installed in the reading region 4. The surface of the original 2 passing over the transparent plate 10 is exposed to light from an exposure lamp of the optical system which is not shown in the drawings to read the image of the original, and copy process is carried out in the copier. The original 2 whereof the image on one surface has been read is transported through the transport path 7 and is placed at the bottom of the original sheets 2 stacked in the document hopper 3.

Every time the original 2 is fed from the document hopper 3 and returned through the reading region 4 to the bottom of the document hopper 3, relation of the top and bottom faces of the returned original 2 is inverted from that before being fed. That is, one surface of the original 2 which faced upward in FIG. 1 when being fed from the document hopper 3 faces downward when the original 2 is stacked in the document hopper 3 after passing the reading region 4. Copy of both sides of the two-sided originals, which carry information recorded on both sides of each sheet, onto corresponding surface of copy paper, namely duplex copy is carried out as follows. When one surface of a sheet of the original is read, the original is returned to the document hopper 3, where the original is stacked with the surface which faced upward before copying now facing downward. Therefore, in case of paper jamming in the transport path 6 after the original 2 has been fed again from the document hopper 3 to read another surface of the original 2 which has not been read, the original 2 may be stacked again without noticing that the original 2 is inverted from the face-bottom direction at the time of the initial stacking, when returning the original 2 which caused the jam to the document hopper 3, thereby causing the wrong surface to be copied mistakingly, resulting in poor operation performance.

Also according to the constitution of the RDH 1 of the prior art, the original 2 is always fed from the top of the stack of the original sheets in the document hopper 3 to the right in FIG. 1 and is, after reading operation, returned to the document hopper 3 at the bottom of the stacked originals from the right. Consequently, because the mechanism of feeding the original to the transport path 6 and the mechanism of recovering the original from the transport path 7 are concentrated at one side (right-hand side in the case of FIG. 1) of the document hopper 3, structure of the document hopper 3 is complicated on one side.

Further in the RDH 1, the document hopper 3 is made in a configuration of top-feed, bottom-return scheme where the original is fed from the top of the original stack and is returned to the bottom of the stack. The mechanism of returning the original 2 to the bottom of the stacked originals generally tends to become complicated for the reason of precision. Namely, adoption of the top-feed, bottom-return configuration for the document hopper 3 also makes the structure around the document hopper complicated.

SUMMARY OF THE INVENTION

An object of the invention is to provide a document feeder where the original document stacked in the document hopper is placed with the same surface facing upward as that when it was initially stacked during copying operation, and it is possible to simplify the structure around the document hopper.

The invention provides a document feeder comprises;

a document hopper which feeds original documents from the bottom on one side of document stack and returns them to the top of the stack on other side, a first guide member which guides the original document to the first reading region to read one surface of the original document fed from the document hopper, a second guide member which guides the original document to a second reading region to read other surface of the original document, first document inverting means which is installed between the first guide member and the second guide member and inverts the top and bottom of the original document and the transport direction thereof, and second document inverting means which is installed at downstream of the original document transport direction with respect to the second guide member and inverts the original document transport direction without inverting the upper and lower surfaces of the original document and returns the original document to the document hopper.

According to the invention, in the document feeder which transports original document sheets for reading, lowermost sheet of the original documents stacked in the document hopper is fed from one end thereof and is transported. The original document which is fed is guided by the first guide member to the first reading region where one surface of the original document is read. The original document whereof one surface has been read in the first reading region is inverted with regard to its both upper-under side direction and the transport direction thereof, and is transported to the second guide member. The original document is guided by the second guide member to the second reading region, where other face of the original document is read. The original document which has been read is transported to the second document inverting means where the transport direction of the original document is inverted without inverting the upper-under side direction, and is returned to the top of the original documents stacked in the document hopper from other side thereof.

Therefore, the original documents shows always the same face upward in the document hopper. Also, in the neighbor of the document hopper, an original feeding mechanism and a document recirculating mechanism are disposed to oppose each other with the document hopper interposed in-between, and are arranged in bottom-feed, top-restack configuration, making the structure around the document hopper free from complication.

According to the invention, the original documents shows always the same face upward in the document hopper during copying operation. Therefore when a trouble such as jamming of the original document has occurred during transport of the original document, the original document causing the jam may be restacked in the document hopper with the same surface facing upward as that faced upward when the original document was initially stacked in the document hopper. Consequently, copying a wrong surface is prevented and the operating performance is improved.

Also because the original document feeding mechanism and the original document restacking mechanism are disposed on both sides of the document hopper without being concentrated on either side, the structure around the document hopper is not complicated. Further the structure around the document hopper is simplified also by adopting bottom-feed, top-restack configuration for the document hopper.

The invention provides a document feeder has the second document inverting means comprises;

a support cylinder, formed like a straight cylinder shape, which transports the original document in close contact onto the outer periphery and rotates either in forward or reverse directions, a first transport path which transports the original document to the outer periphery of the support cylinder from the second guide member, a second transport path which transports the original document to the document hopper from the outer periphery of the support cylinder, a direction inverting claw, installed nearly the outer periphery of the support cylinder, which separates the original document from the outer periphery of the support cylinder and leads the original document to the second transport path.

The invention provides a document feeder has the support cylinder having a plurality of sucking port on the outer periphery and being connected a sucking means to the inside, makes the original document in close contact onto the outer periphery by driving the sucking means.

The invention provides a document feeder has the first guide member comprises;

a first curved guide plate formed like a curved shape along a transport path and installed opposing to a first transparent plate for the first reading region, and plurality of transport rollers disposed at upstream and downstream of the first curved guide plate, the second guide member comprises;

a second curved guide plate formed like a curved shape along a transport path and installed opposing to a second transparent plate for the second reading region, and plurality of transport rollers disposed at upstream and downstream of the second curved guide plate.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
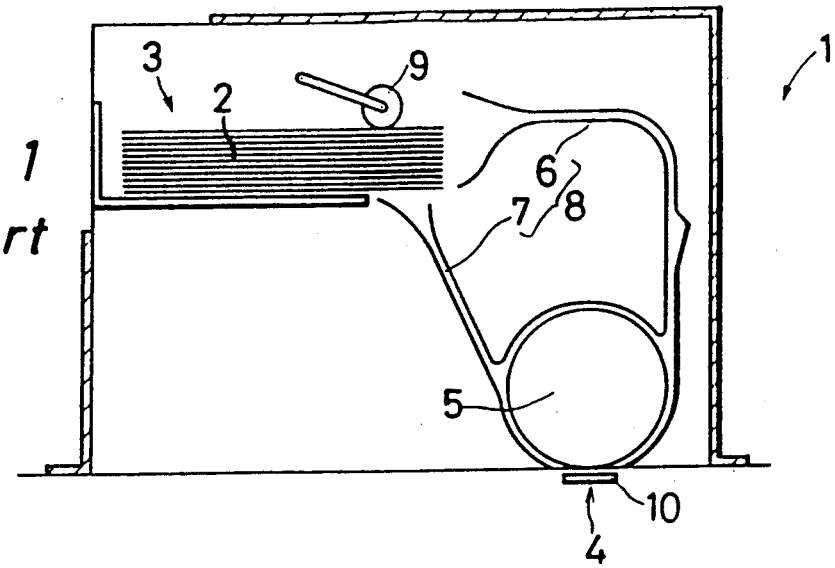
Fig. 1 Prior Art
FIG. 1 is a sectional view of a simplified constitution of RDH 1 of the prior art.

Now referring to the drawing, preferred embodiments of the invention are described below.

Figure 3:
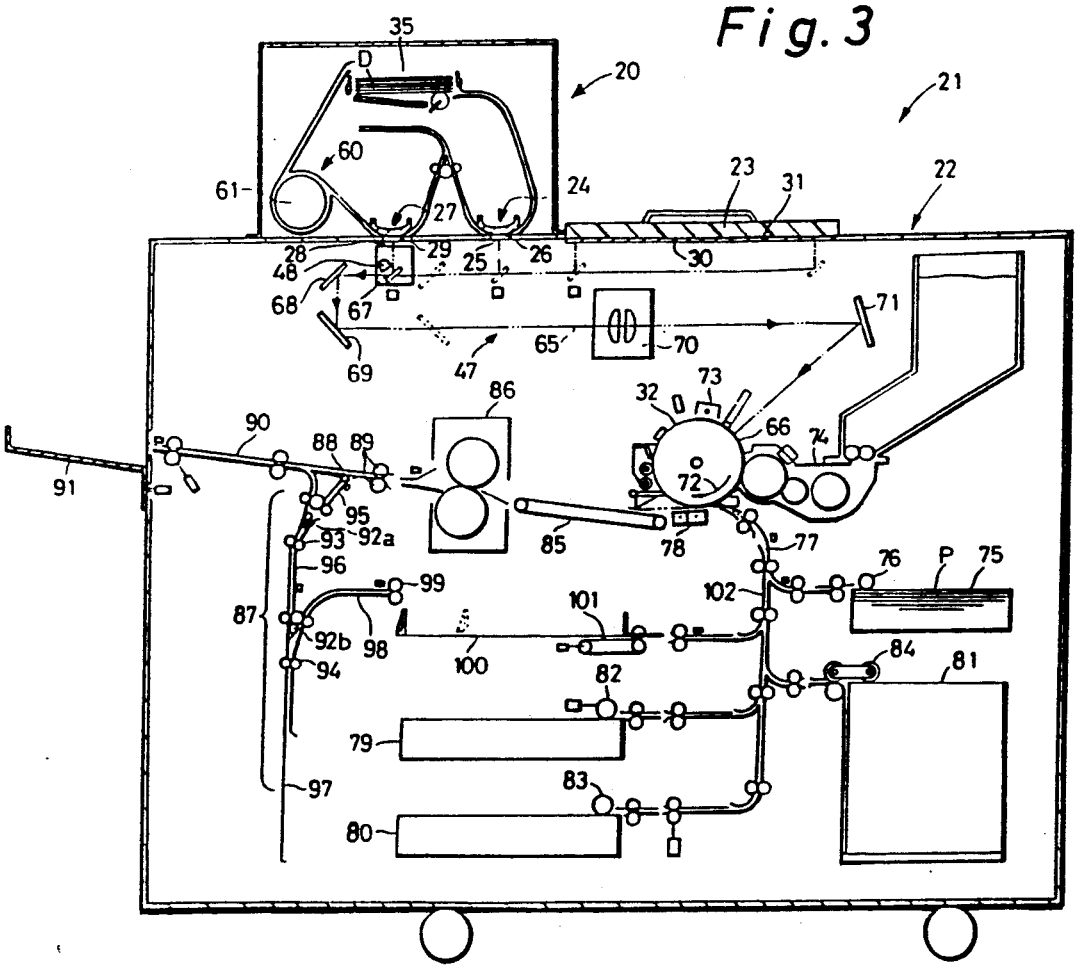
FIG. 3 is a simplified sectional view of a transfer type electrostatographic copier 21 equipped with RDH 20.
Figure 2:
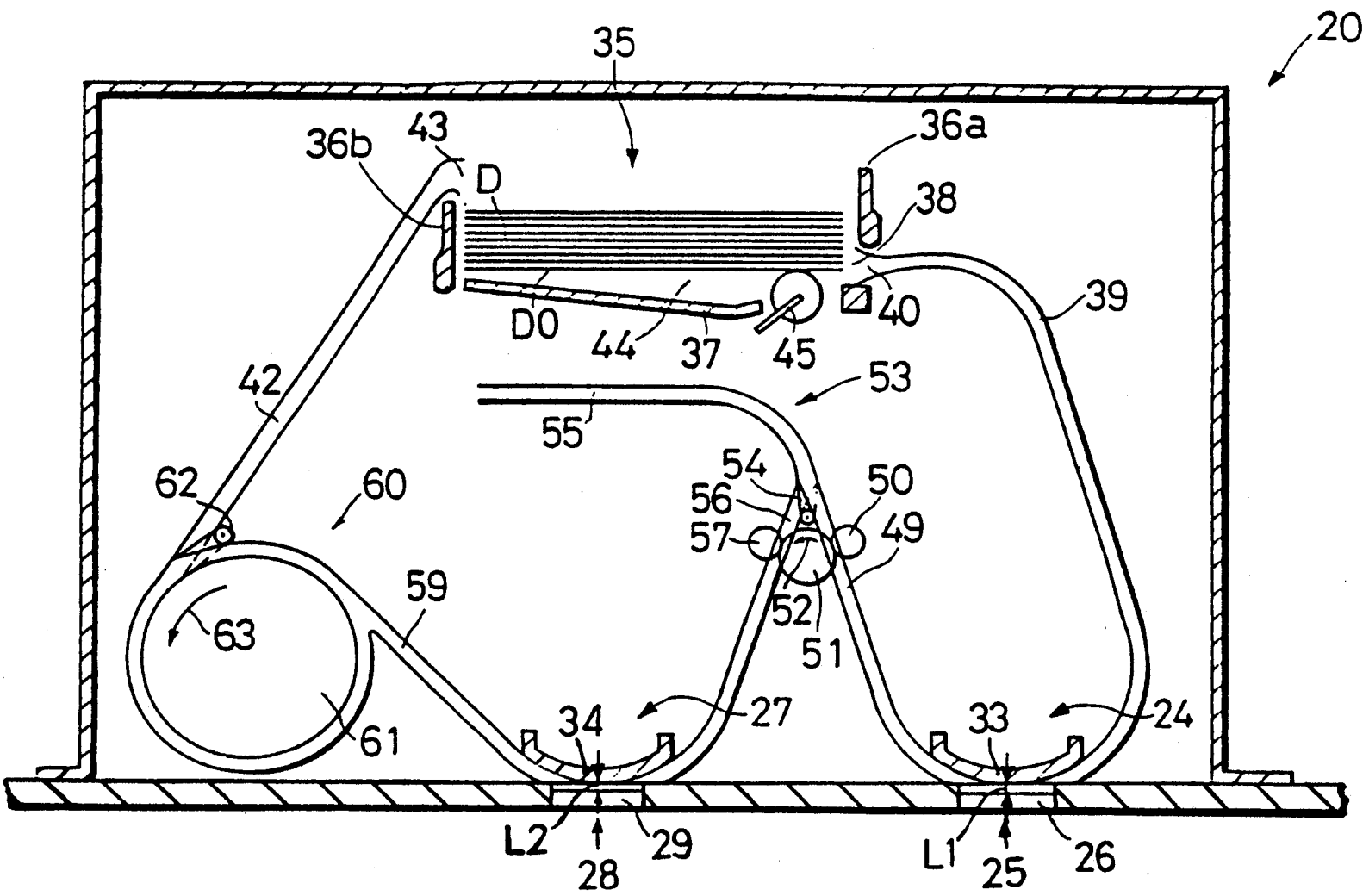
FIG. 2 is a sectional view illustrative of the simplified structure of RDH 20 which is an embodiment of the invention.

FIG. 2 is a simplified sectional view of a recirculating automatic document feeder (called RDH hereafter) which is an embodiment of the invention, and FIG. 3 is a simplified sectional view of a transfer type electrostatographic copier 21 equipped with RDH 20. Mounted on top of the body 22 of the transfer type electrostatographic copier 21 are RDH 20 for the reading of original document sheets and a thick document pressing platen 23 which covers voluminous original documents such as books.

Also mounted on top of the body 22 is a first transparent plate 26 for a first reading region 25 at a position opposing to the bottom of a first guide member 24 which transports the original sheet in the RDH 20, and a second transparent plate 29 for a second reading region 28 at a position opposing to the bottom of a second guide member 27 which transports the original sheet. Further mounted on top of the body 22 is a third transparent plate 31 for a third reading region 30 which reads thick original documents at a position opposing to the thick document pressing platen 23.

When copying an original sheet D, the original sheet D is stacked in a document hopper 35 which is installed in the RDH 20. The document hopper 35 comprises side walls 36*a*, 36*b* and a bottom plate 37. The side wall 36*a* has an opening 38 formed therein at a lower position in the direction (downward in FIG. 2) of stacking the original documents D, with a transport entrance 40 of the transport path 39 provided nearby. Provided on the side wall 36*b* at an upper position in the direction of stacking the original D is a transport exit 43 of the transport path 42 to return the original D, which has been read as will be described later, to the document hopper 35.

The bottom plate 37 forms a gradual recess 44, and a feed roller 45 which feeds the original D makes contact with a lowermost original sheet D0 of the document stack D, to make feed operation. Even when the lowermost document D0 is guided to the transport entrance 40 of the transport path 39 with multiple original sheets following thereto, these sheets are separated by a separation roller not shown, thereby being transported to the transport path 39 one by one separately.

The original D which has been transported to the transport path 39 is transferred to the first guide member 24. The first guide member 24 comprises a first curved guide plate 33 disposed opposing to the first transparent plate 26 and plurality of transport rollers not shown which are disposed at upstream and downstream of the first curved guide plate 33 in the direction of transporting the original D. The curved guide plate 33 is, for example, a sheet-like object made of steel or the like curved along the transport path. A gap L1 formed between the curved guide plate 33 and the first transparent plate 26 has a clearance of about 1 mm to allow the original D to pass therethrough.

The original D, when transported to the first guide member 24, is guided by the transport roller and others to pass over the first transparent plate 26 in the first reading region 25 via the gap L1. When the original D passes over the first transparent plate 26, one surface of the original D is exposed to light of an exposure lamp 48 of an optical system (refer to FIG. 3) provided near the first reading region 25, to transfer the image of one surface of the original D onto a photo-sensitive material 32 through an optical system 47..

The original D whereof one surface has been read is transported to the transport path 49. The transport path 49 is provided with transport rollers 50, 51. As the transport roller 51 rotates in the direction of arrow 52, the transport roller 50 which is in contact with the transport roller 51 rotates in a direction reverse to the arrow 52. These transport rollers 50 and 51 transport the original D which has been transported to the transport path 49, to the first document inverting means 53.

The first document inverting means 53 has a direction inverting claw 54 and a reversible transport roller not shown. While the original D is transported from the transport path 49 to the transport path 55 of the first document inverting means 53, the direction inverting claw 54 is set in the position indicated by solid line in FIG. 1. When an edge at the upstream side in the transport direction of the original D which is transported to the transport path 55 of the first document inverting means 53 passes the direction inverting claw 54, the original D begins to be transported to the transport path 49 from the transport path 55 by the transport roller not shown. At the same time, because the direction inverting claw 54 is shifted from the position indicated by solid line to the position indicated by imaginary line in FIG. 2, the original D is transported from the transport path 55 to the transport path 56. By passing the first document inverting means 53, the surface of the original D which is read and exposed in the second reading region 28 installed as described later becomes other surface of the original D which is not read in the first reading region 25 which the original D has already passed through.

Installed in the transport path 56 are the transport roller 51 and a transport roller 57. Because the transport roller 51 is rotating in the direction of arrow 52, the transport roller 57 which is in contact with the transport roller 51 rotates in a direction opposite to the arrow 52. The original D which has been transported to the transport path 56 is transported to the second guide member 27 by these transport rollers 51, 57.

The second guide member 27 has a structure similar to that of the first guide member 24, for example, and includes a second curved guide plate 34 and plurality of transport rollers not shown. The second curved guide plate 34 opposes the second transparent plate 29 in the second reading region 28, and a gap L2 formed by the second curved guide plate 34 and the second transparent plate 29 is made comparable to the gap L1 in the first guide plate 24. The original D which has been transported from the first document inverting means 53 to the second guide member 27 is transported by the transport rollers through the gap L2 and passes over the second transparent plate 29 in the second reading region 28. In the second reading region 28, other surface of the original D passing over the second transparent plate 29 is exposed to light from the exposure lamp 48, and the image thereon is read onto the photo-sensitive material 32 via the optical system 47. The original D whereof other surface has been read is transported to the transport path 59.

Installed at the downstream of the transport path 59 is a second document inverting means 60. The second document inverting means 60 comprises a support cylinder 61 of a straight cylinder shape and a direction inverting claw 62. Formed on the outer periphery of the support cylinder 61 are plurality of a sucking port, for example, not shown, and sucking means is connected to the inside of the support cylinder 61. Thus, by driving the sucking means, the original D which has been transported onto the outer periphery of the support cylinder 61 is supported in close contact and is transported. Further the support cylinder 61 is made in a structure capable of rotating either in forward or reverse directions, and has a function of inverting the direction of transporting the original.

The original D which has been transported to the second document inverting means 60 via the transport path 59 is carried by the support cylinder 61 rotating in the direction of the arrow 63 in close contact thereto. While the original D is transported in the direction of the arrow 63 in close contact with the support cylinder 61, the direction inverting claw 62 is set in the position indicated by the solid line in FIG. 2. When an edge on the upstream side of the original D in the transport direction passes through the direction inverting claw 62, the support cylinder 61 starts to rotate in a direction opposite to the arrow 63. Because the direction inverting claw 62 is shifted from the position indicated by the solid line to that indicated by the imaginary line in FIG. 2 at the same time as the support cylinder 61 starts to rotate in the opposite direction, the original D which has been in close contact with the support cylinder 61 is separated from the support cylinder 61 by the tip of the direction inverting claw 62, and is transported to the transport path 42. Therefore only the direction of the transporting the original D is inverted by passing through the second document inverting means 60, without inverting the surface of the original D facing upward.

The original D which has been transported to the transport path 42 is guided into the document hopper 35, where it is stacked on top of the original document stack through the transport exit 43 of the transport path 42. In case the original D is transported as described above, the original D always shows the same face upward regardless of whether it is before being fed from the document hopper 35 or it is returned to the document hopper 35 and restacked after being fed and read.

Therefore even when the original D causes jam in the course of transport, operation can be resumed simply by replacing the original D which caused the jam at the bottom of the document stack in the document hopper 35 with the same surface facing upward as that faced upward when it was stacked at the first, resulting in improved performance.

Also because the feeding mechanism which feeds the original D from the document hopper 35 and the restacking mechanism which returns the original D to the document hopper 35 and restacks it are so disposed as to oppose to each other at both sides of the document hopper 35, without being concentrated on one side of the document hopper 35 in the neighbor of the document hopper 35, such a situation does not occur as the structure of only one side of the document hopper 35 is complicated, resulting in simplified structure around the document hopper 35. Further in the feeding mechanism and the restacking mechanism, so-called bottom-feed, top-restack configuration is adopted thereby also making it possible to simplify the structure around the document hopper 35.

As described above, when the original is exposed to light of the exposure lamp 48 of the optical system 47 in the first reading region 25 and the second reading region 28, or in the third reading region 30 which is for the reading of thick originals, the light reflected from the surface of the original is guided by the optical system 47 via an optical path 65 to form an image on an exposure section 66 located on the photo-sensitive material 32. The optical system comprises an exposure lamp 48, reflectors 67, 68, 69, a zoom lens 70 and a reflector 71.

The photo-sensitive material 32 which is driven to rotate in the direction of an arrow 72 is first charged by a main corona discharger 73. Then, as described above, image of the original read in the reading regions 25, 28, 30 by the optical system 48 is formed in the exposure region 66, thereby forming an electrostatic latent image corresponding to the surface of the original. The electrostatographic latent image formed is developed by a developing device 74 into a toner image. The toner image is transferred by a transfer corona discharger 78 onto a copy paper P which has been fed from a cassette 75 by a feed roller 76 and transported to the transport path 77.

In FIG. 3, cassettes 79, 80, 81 are provided besides the cassette 75 which houses the copy paper P. The cassettes 79, 80, 81 accommodate copy papers of different sizes which are transported to the transport path 77 by the feed rollers 82, 83, 84 in accordance to the application for the copying operation to be carried out thereafter.

The copy paper P which has received the transfer of an image is transported by a transportation means to an image fixer 86 for fixation. When copying onto only one surface of the copy paper P, namely in the case of simplex copy, the first direction inverting claw 88 which is a part of a copy paper inverting means 87 is set in the position indicated by solid line in FIG. 3. Therefore the copy paper P whereon an image has been fixed is transported by a transport roller 89 to the transport path 90 and then discharged onto a discharge tray 91. In the case of duplex copy where images are copied onto both sides of a copy paper P, the copy paper P which has received image transferred onto one surface thereof is not discharged onto the discharge tray 91 but is transported to the copy paper inverting means 87 in order to copy onto other surface.

The copy paper inverting means 87 comprises a first direction inverting claw 88, a second direction inverting claw **92*a*, a third direction inverting claw 92*b* and a pair of reversible transport rollers 93, 94. Because the first direction inverting claw 88 and the second direction inverting claw 92*a* are set in the positions indicated by the imaginary line in FIG. 3, the copy paper P which has received image transferred onto one surface thereof is transported to transport paths 95, 96**.

The copy paper P which has been transported by the transport roller 93 to the transport path 96 is further transported to the transport path 97 because the third direction inverting claw **92*b* is set in the position indicated by imaginary line in FIG. 3. When an upstream side edge of the copy paper P being transported to the transport path 97 passes the third direction inverting claw 92*b*, the transport roller 94 rotates to return the copy paper P to the transport path 96 and, at the same time, switches the third direction inverting claw 92*b* to the position indicated by solid line in FIG. 3, thereby transporting the copy paper P from the transport path 97 to the transport path 98. The copy paper P which is transported to the transport path 98 is discharged onto an intermediate tray 100 by a discharge roller 99**.

The copy paper P which is placed in the intermediate tray 100 is fed again by a feed roller 101 to be transported through transport paths 102, 77 to the photo-sensitive material 32 where it receives copying onto other surface thereof whereon no image has been copied yet. The copy paper P which received images copied on both surfaces thereof in the above procedure is transported to the copy paper inverting means 87. Because the first direction inverting claw 88 and the second direction inverting claw **92*a* of the copy paper inverting means 87 remain to be set in the positions indicated by the imaginary line in FIG. 3, the copy paper P which has been transported is transported to the transport paths 95, 96**.

When the upstream side edge of the copy paper P being transported to the transport path 96 passes the second direction inverting claw **92*a*, the transport roller 93 rotates in the reverse direction and, at the same time, switches the second direction inverting claw 92*a* to the position indicated by the solid line in FIG. 3. Therefore the copy paper P is turned upside down and the direction of transport thereof is inverted and the copy paper P passes through the transport path 90 to be discharged onto the discharge tray 91. In case it is out of consideration which surface of the copy paper paper P being discharged to the discharge tray 91 should face upward, the copy paper P which has completed the duplex copy process may be directly discharged onto the discharge tray 91 by switching the first direction inverting claw 88 of the copy paper inverting means 87 to the position indicated by solid line in FIG. 3**.

Figure 4A:
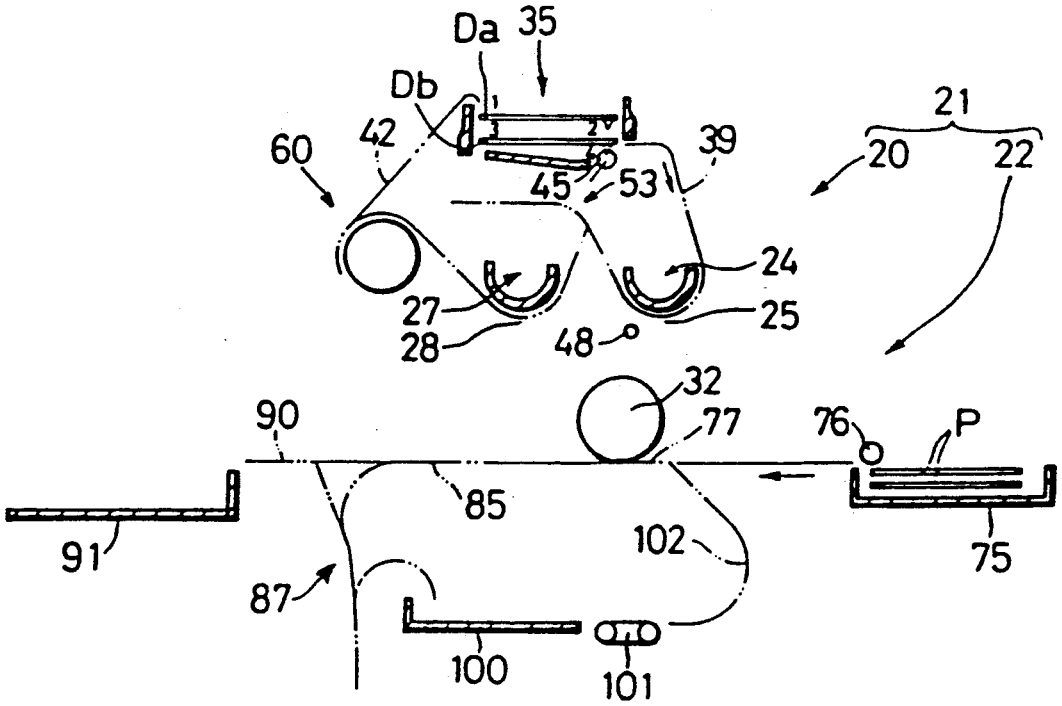
FIG. 4(A) is a simplified sectional view of a transfer type electrostatographic copier 20 at a first state of the duplex copy operation of double-sided original document.
Figure 4B:
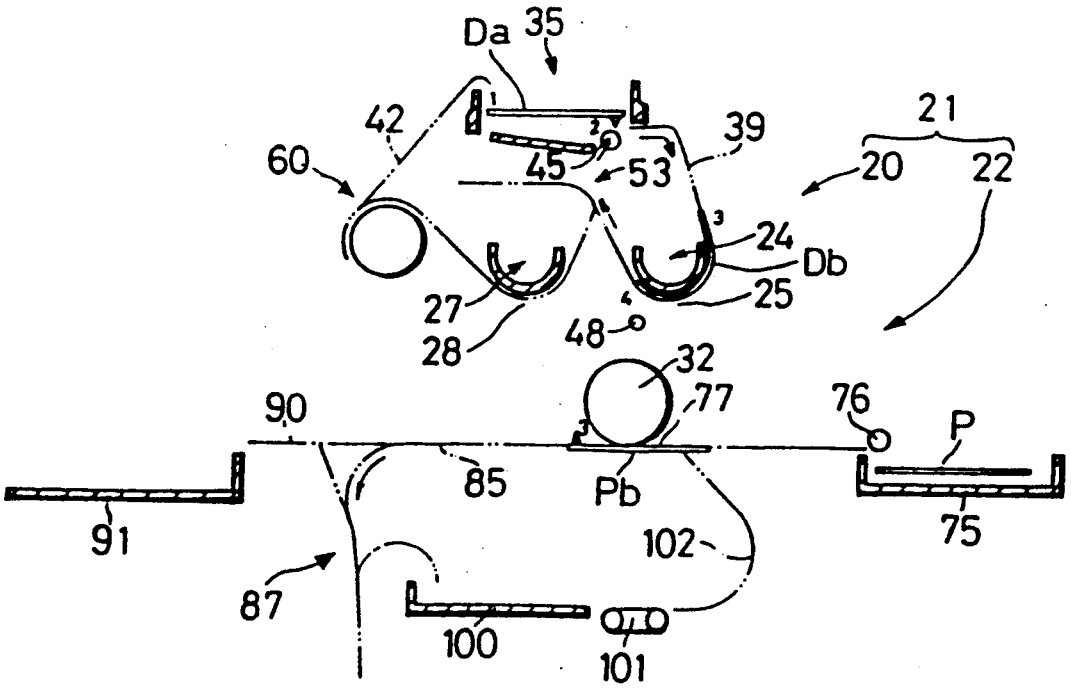
FIG. 4(B) shows the simplified sectional view of FIG. 4(A) at the next stage of such operation.
Figure 4C:
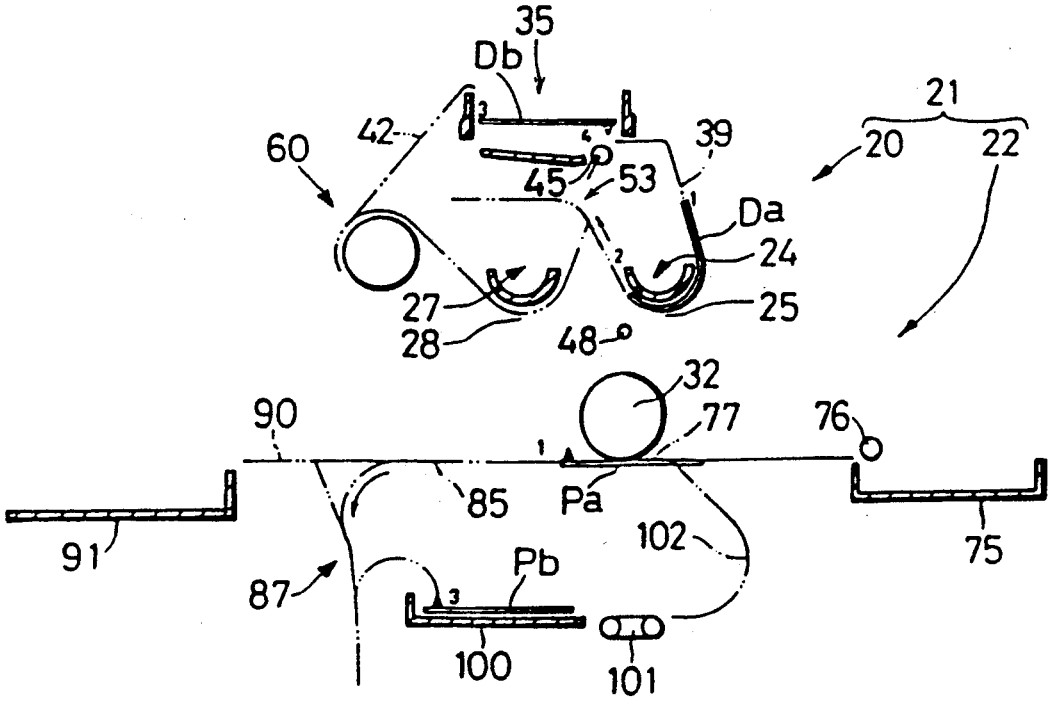
FIG. 4(C) shows the simplified sectional view of FIG. 4(A) at a next stage of such operation subsequent to that of FIG. 4(B)
Figure 4:
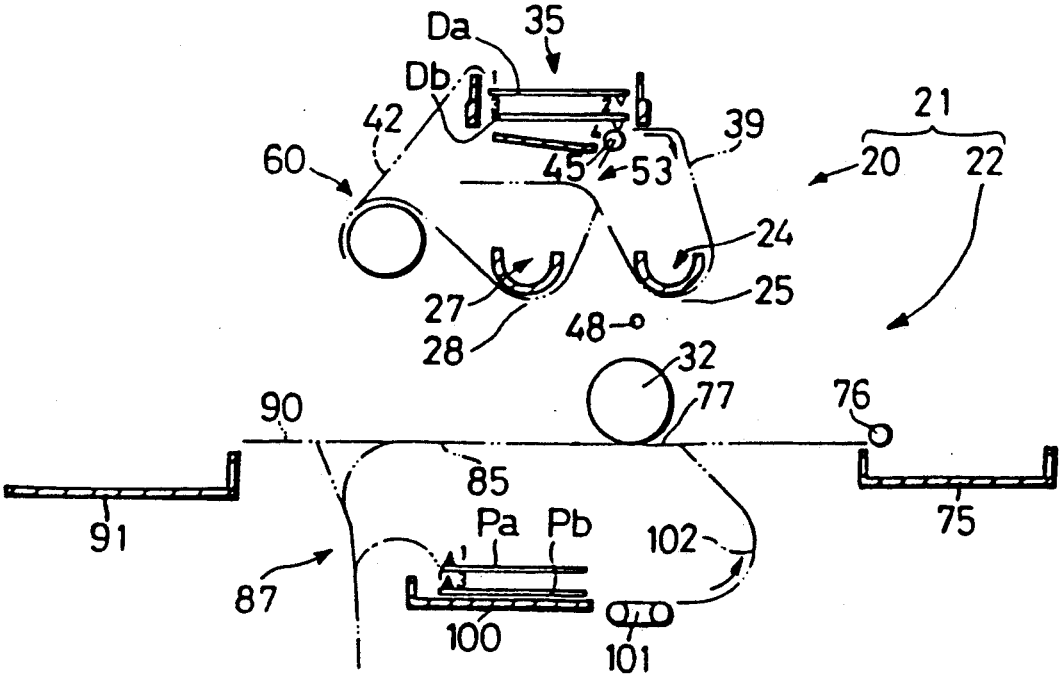
FIG. 4(D) shows the simplified sectional view of FIG. 4(A) at a next stage of such operation subsequent to that of FIG. 4(C)
FIG. 4(E) shows the simplified sectional view of FIG. 4(A) at a next stage of such operation subsequent to that of FIG. 4(D)
FIG. 4(F) shows the simplified sectional view of FIG. 4(A) at a next stage of such operation subsequent to that of FIG. 4(E)
FIG. 4(G) shows the simplified sectional view of FIG. 4(A) at a next stage of such operation subsequent to that of FIG. 4(F)
FIG. 4(H) shows the simplified sectional view of FIG. 4(A) at a next stage of such operation subsequent to that of FIG. 4(G)
Figure 4E:
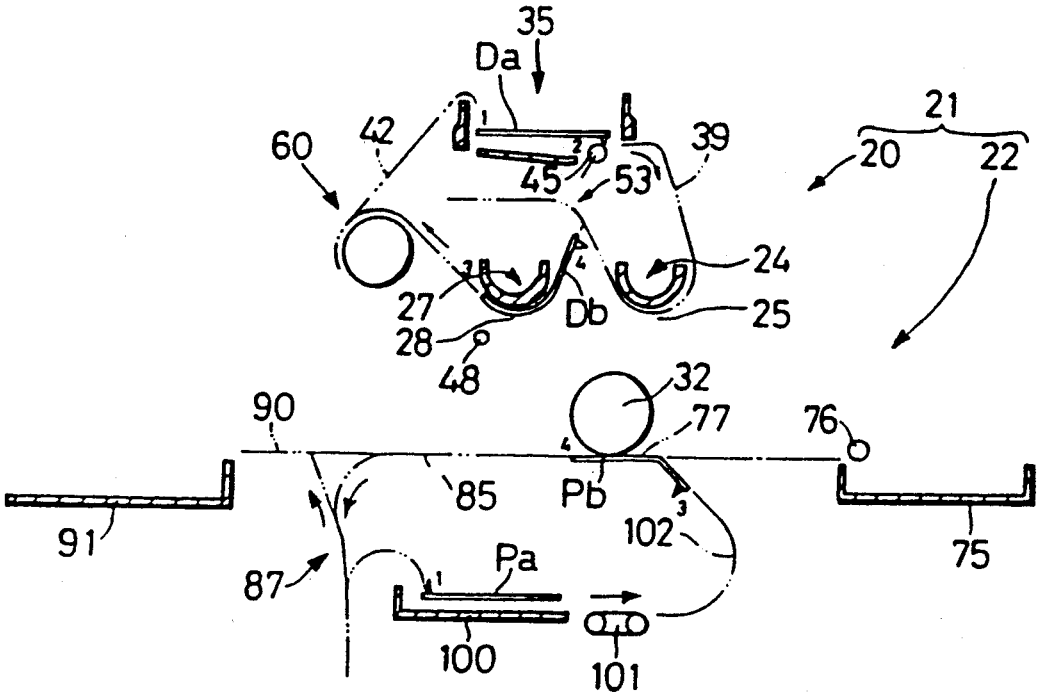
Figure 4F:
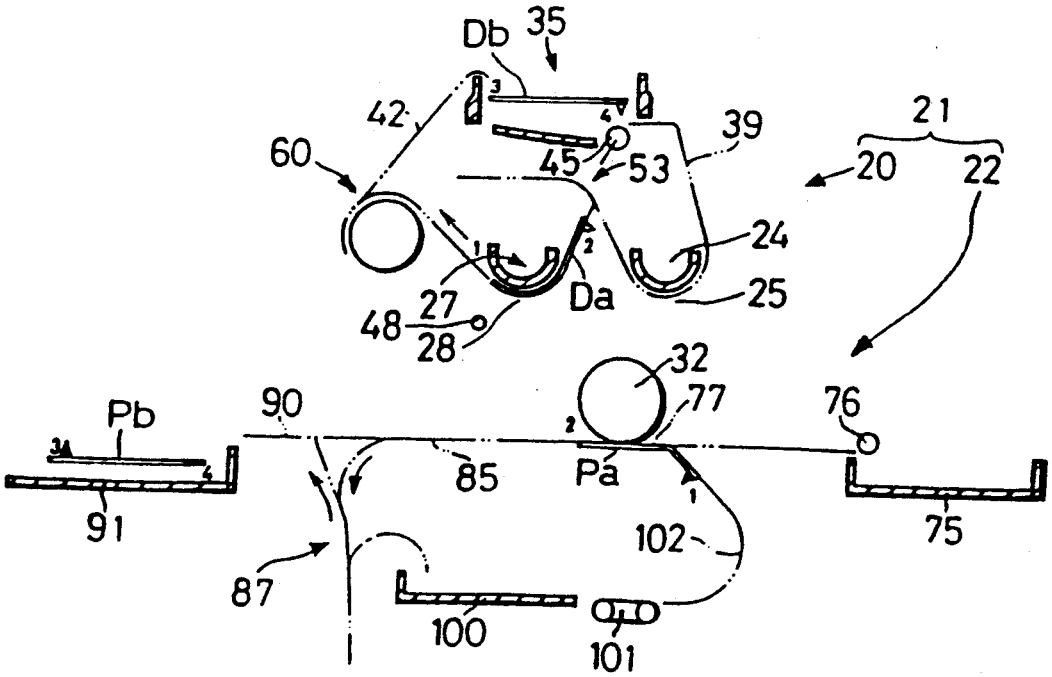
Figure 4G:
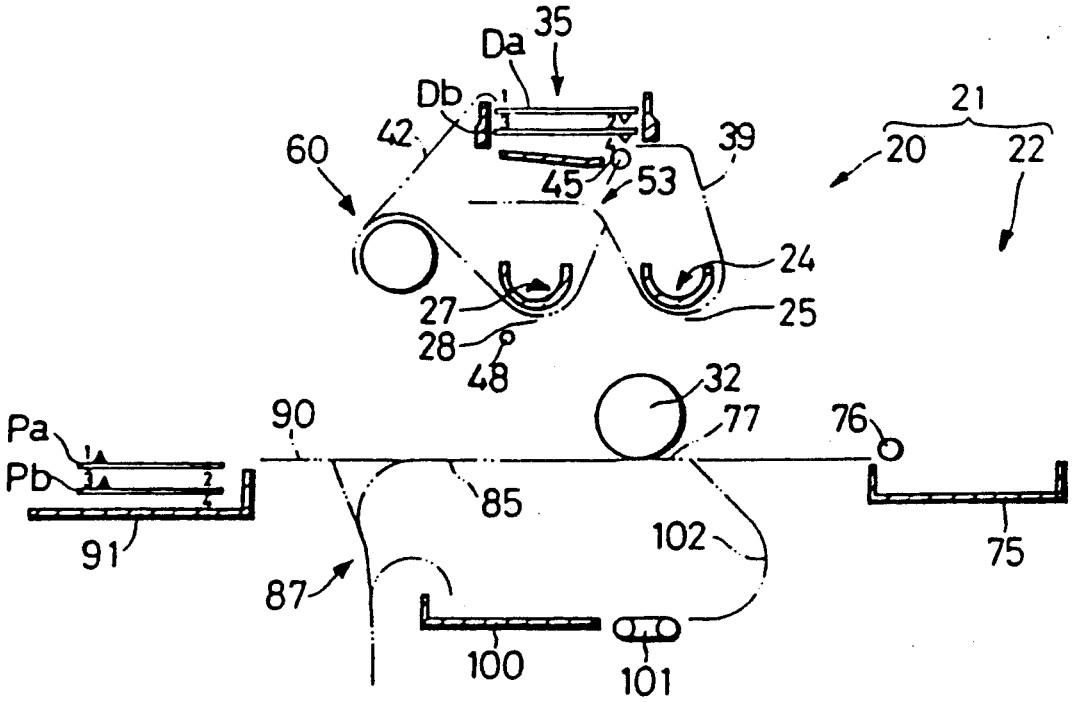
Figure 4H:
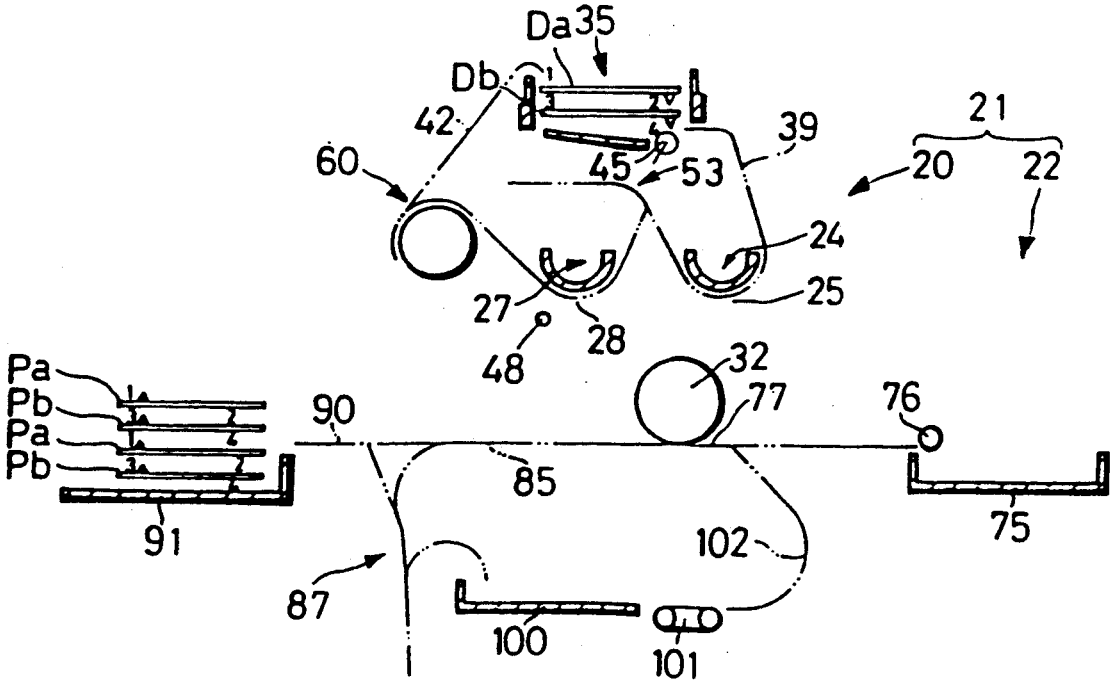

FIG. 4 is a simplified sectional view of a transfer type electrostatographic copier 21 explanatory of the duplex copy process of double-sided original documents, with two original document sheets Da and Db depicting the duplex copy process. In the description that follows, subscript "a" represents a first document surface and subscript "b" represents a second document surface in the representation of the original document D. Numerical subscripts 1 through 4 represent the page numbers of a set of stacked documents D. For example, page 1 of the first original document D is denoted as Da1. Surfaces of the copy paper P are also represented by attaching subscripts a, b and 1 through 4. An original document sheet D and a copy paper P which have the same subscript attached to the reference codes thereof have the relationship of a surface of an original document D to be read and a surface of a copy paper P whereon the image read from the surface of the original document D is copied thereto.

For the sake of convenience, a numerical figure representing the page number will be marked on a surface of each original document D in the drawings and, on the surface of an even page number in particular, a triangular mark with the inside painted in white will be marked. Each copy paper P will be given on a surface thereof which has completed copying process a numerical figure indicating the surface of the original document from which the copy was made and, on an odd-numbered page in particular, a triangular mark with the inside painted in black will be marked. Subscripts will be omitted when referring to the original D and the copy paper P in general.

To make duplex copy of the two sheets of original documents Da, Db, the originals Da, Db are stacked in the document hopper 35 in the RDH 20 so that the page number increases downward from the top to the bottom of the stack as shown in FIG. 4(1). The copy papers P are stacked in the cassette 75 in the body 22.

When the process of duplex copy is started, second original Db at the lowermost position of the original document sheets D stacked in the document hopper 35 is transported by the feed roller 45 to the transport path 39 as shown in FIG. 4(2). The second original Db transported to the transport path 39 passes the first guide member 24 and the first reading region 25. In the first reading region 25, one surface of the second original Db, page 3 Db3, is exposed to light of the exposure lamp 48. Light reflected from the surface of page 3 of the second original Db3 is focused on the photo-sensitive material 32, forming an electrostatic latent image corresponding to the page 3 of the second original Db3. A toner image which is obtained by developing the latent image is transferred onto one surface of the second copy paper Pb which has been transported from the cassette 75 to the transport path 77 by the feed roller 76.

The second original Db whereof page 3 Db3 has been read in the first reading region 25 passes the first original inverting means 53 and, via the second guide member 27, passes the second reading region 28. In the second reading region 28, no reading operaton is done, and the direction of transporting the second original Db is inverted by the original inverting means 60 and passes the transport path 42 to be stacked in the document hopper 35 at top of the first original document Da. When the second original Db passes the first rading region 25, the second copy paper Pb whereon the image of page 3 Db3 has been copied on one surface thereof passes the transport path 85 and the copy paper inverting means 87 to be stacked in the intermediate tray 100.

After the second original Db has been stacked in the document hopper 35, the first original document Da is fed by the feed roller 45 and is transported to the transport path 39 as shown in FIG. 4(3). The first original Da which has been transported to the transport path 39 passes the first guide member 24 and then through the first reading region 25. In the first reading region 25, one surface of the first original, page 1 Da1, is exposed to light of the exposure lamp 47. Light reflected from the surface of page 1 of the first original Da1 is focused on the photo-sensitive material 32, forming an electrostatographic latent image corresponding to the page 1 of the first original Da1. A toner image which is obtained by developing the latent image is transferred onto one surface of the first copy paper Pa which has been transported from the cassette 75 to the transport path 77 by the feed roller 76.

The first original Da whereof page 1 Da1 has been read in the first reading region 25 passes the first original inverting means 53 similarly to the second original Db and, via the first guide member 27, passes the second reading region 28 without being read. Thereafter the first original Da passes the second original inverting means 60 and passes the transport path 42 to be stacked in the document hopper 35 at top of the second original document Db as shown in FIG. 4(4). As described before, two originals Da, Db which have been stacked after being read are stacked so that the page number increases from the top to the bottom of the stack, same as when they were stacked initially. In the first reading region 25, the first copy paper Pa whereon the image of page 1 Da1 of the first original has been copied on one surface thereof passes the transport path 85 and the copy paper inverting means 87 to be stacked on top of the second copy paper Pb in the intermediate tray 100. The copy papers Pa, Pb stacked in the intermediate tray 100 in the order of the second copy paper Pb and the first copy paper Pa from the bottom upward, and in such a manner that the surfaces whereon the images of the originals are copied face upward in FIG. 4(4).

When the first original Da is returned to the document hopper 35 and stacked therein, the second original Db is fed again by the feed roller 45 and is transported to the transport path 39. The second original Db which is transported to the transport path 39 is transported to the first original inverting means 53 without being read in the frist reading region 25. The second original Db which has been inverted while passing the first original inverting means 53 passes the second guide member 27 and the second reading region 28 as shown in FIG. 4(5). Other surface of the second original Db, page 4 Db4, which has not yet been read is exposed in the second reading region 28 to light of the exposure lamp 48 which has been moved from the first reading region 25 to the second reading region 28. Light reflected from the surface of page 4 of the second original Db4 is focused on the photo-sensitive material 32, forming an electrostatographic latent image corresponding to the page 4 of the second original Db4. The second copy paper Pb which has completed copying on one surface thereof and is placed at the lowermost position of the copy papers P stacked in the intermediate tray 100 is fed by the feed roller 101 and is transported to the photosensitive material 32 through the transport paths 102. 77. A toner image which is obtained by developing the latent image formed on the photosensitive material 32 is transferred onto other surface of the second copy paper Pb which has been transported to the photo-sensitive material 32.

The second original Db whereof page 4 Db4 has been read in the second reading region 28 passes the second original inverting means 60 and is transported to the transport path 42 to be returned and stacked on top of the first original Da stacked in the document hopper 35. The second copy paper Pb which has completed copying on both sides thereof is, after being inverted in the copy papere inverting means 87, discharged to the discharge tray 91 via the transport path 90.

When the second original Db is returned to the document hopper 35 and is stacked, the first original Da is fed again by the feed roller 45 to the transport path 39. The first original Da transported to the transport path 39 passes over the first reading region 25 without being read similarly to the case of the second original Db, and is transported to the first document inverting means 53. The first original Da which has been inverted when passing the first document inverting means 53 passes, via the second guide member 27, over the second reading region 28 as shown in FIG. 4(6). In the second reading region 28, other surface of the first original, page 2 Da2, is exposed to light of the exposure lamp 48. Light reflected from the surface of page 2 Da2 of the first original is focused on the photo-sensitive material 32, forming an electrostatographic latent image corresponding to the page 2 of the first original Da2. The first copy paper Pa which has completed copying on one surface thereof and has been stacked in the intermediate tray 100 is fed by the feed roller 101 and is transported to the photosensitive material 32 via the transport path 102, 77. A toner image which is obtained on the photosensitive material 32 by developing the electrostatic latent image which corresponds to page 2 of the first original Da2 is transferred onto other surface of the first copy paper Pa which has been transported thereto.

The first original Da whereof page 2 has been read in the second reading region 28 is transported through the second original inverting means 60 to the transport path 42 and then returned and stacked on top of the second original Db stacked in the document hopper 35 as shown in FIG. 4(7). The first copy paper Pa which has completed the copying on both sides thereof is inverted in the copy paper inverting means 87 and passes through the transport path 90 to be discharged onto top of the second copy paper Pb stacked in the discharge tray 91.

The procedure described above completes the duplex copy operation of the two originals Da, Db. Therefore one surface of the first copy paper Pa carries the image of the first original page 1 Da1 copied thereon and other surface thereof carries the image of the first original page 2 Da2 copied thereon. And one surface of the second copy paper Pb carries the image of the second original page 1 copied thereon and other surface thereof carries the image of the second original page 4 Db4 copied thereon.

After the duplex copy has been completed, the originals D are stacked in the document hopper 35 in such an order as the page number increases successively from top to the bottom, in the same arrangement as that when they were stacked when starting the duplex copy process. Therefore copy process can be done again and the originals can be taken out in the same condition as that when stacked initially. On the other hand, the copy papers P are stacked in the discharge tray 91 in such an order as the page number increases successively from the top downward.

FIG. 4(8) shows the condition of making duplex copy of the two originals Da, Db again from the condition in FIG. 4 (7). Because the procedure of FIG. 4(1) through FIG. 4(7) has been repeated twice in this condition, two sets of the two copy papers Pa, Pb are stacked in the discharge tray 91 in separate sets. Consequently, multiple sets of collated copies can be obtained by repeating the procedure of FIG. 4 (1) through FIG. 4(7).

In this embodiment, copy process to make duplex copies of duplex originals is explained. However, other copy processes, for example, simplex copy from duplex originals, simplex copy from simplex originals, and duplex copy from simplex originals can be made. These are explained in the following taking reference to FIG. 3. When either surface of one sheet of original is copied onto one surface each of two copy papers, namely to make simplex copy from a duplex original, the original D is freely stacked in the document hopper 35. The original D at the lowermost position is, after being fed, read on one surface thereof in the first reading region 25 and on other surface thereof in the second reading region 28. When either surface of the original D is copied onto one surface of the copy paper P, the copy paper is immediately discharged onto the discharge tray 91.

When a simplex original which has information to be copied only on one surface thereof is copied onto only one surface of a copy paper, namely to make simplex copy from a simplex original, the original D is stacked in the document hopper 35 which the surface carries the information to read upward in FIG. 3. The original D at the lowermost position is, after being fed from the document hopper 35, read on one surface thereof in the first reading region 25 and passes the second reading region 28 without being read, to be returned and stacked on top of the original D in the document hopper 35. When the surface of the original D read in the first reading region 25 is copied onto one surface of the copy paper P, the copy paper is immediately discharged onto the discharge tray 91.

When two sheets of simplex original are copied onto either surfaces a copy paper sheet, namely to make duplex copy from simplex originals, the originals D are stacked in the document hopper 35 with the surfaces to be read facing upward in FIG. 3. In the stacked originals D, odd-numbered sheets counting from the bottom are called the first originals Da and even-numbered sheets are called the second originals Db. They are called the originals D when referring thereto collectively. The original D is, after being fed, read on one surface to be read thereof in the first reading region 25 and passes the second reading region 28 without being read. The original D which has been read is returned and stacked on top of the originals in the documemnt hopper 35. The copy paper P is, after the surface of the first original Da to be read has been copied thereon, stacked in the intermediate tray 100 via the copy paper inverting means 87. Thereafter, the copy paper P fed again from the intermediate tray 100, and the surface of the second original Db read in the first reading region 25 following the first original Da is copied onto other surface of the copy paper P which is then discharged onto the discharge tray 91. The copy paper P which has completed the copy process onto both sides thereof is now upside down.

The relationship between the surface of the original facing upward in the document hopper and the surface of the copy paper facing upward in the discharge tray is not restricted to that of this embodiment, and any combination may be adopted in accordance to the order of reading in the reading regions 25, 28 and the use of the copy paper inverting means 87.

While a constitution using the curved guide plate and the transport rollers is explained as the guide members to guide the originals to the reading regions in this embodiment, the constitution of the guide members is not restricted to this embodiment and the original may be introduced to the reading region by using a constitution similar to the support cylinder 61. By making such a constitution of the curved guide plate, it is made unnecessary to make a complicated constitution such as support cylinder.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A document feeder comprising;

a document hopper which feeds original documents from the bottom of the original document stack one side thereof and receives the recirculated original documents at the top of the stack on other side thereof, a first guide member which guides the original document fed from the document hopper to a first reading region where one surface of the original document is read, a second guide member which guides the original document to a second reading region where other surface of the original document is read, first document inverting means being installed between the first guide member and the second guide member for turning the original documents upside down and for inverting the direction of transporting the original document, and second document inverting means being installed at the downstream of the second guide member in the direction of transporting the original document, for inverting the direction of transporting the original document without turning the original document upside down and for returning the original document to the document hopper.

2. A document feeder as claimed in claim 1 wherein, the second document inverting means comprises;

a support cylinder, formed like a straight cylinder shape, which transports the original document in close contact onto the outer periphery and rotates either in forward or reverse directions, a first transport path which transports the original document to the outer periphery of the support cylinder from the second guide member, a second transport path which transports the original document to the document hopper from the outer periphery of the support cylinder, a direction inverting claw, installed nearly the outer periphery of the support cylinder, which separates the original document from the outer periphery of the support cylinder and leads the original document to the second transport path.

3. A document feeder as claimed in claim 2, wherein the support cylinder has a plurality of sucking ports on its outer periphery, said ports being connected to a sucking means inside said cylinder to bring the original document into close contact with the outer periphery of said cylinder by the operation of said sucking means.

4. A document feeder as claimed in claim 1 wherein, the first guide member comprises;

a first curved guide plate formed like a curved shape along a transport path and installed opposing to a first transparent plate for the first reading region, and plurality of transport rollers disposed at upstream and downstream of the first curved guide plate, the second guide member comprises;

a second curved guide plate formed like a curved shaped along a transport path and installed opposing to a second transparent plate for the second reading region, and plurality of transport rollers disposed at upstream and downstream of the second curved guide plate.

* * * * *